US011097891B1

(12) United States Patent
Patak

(10) Patent No.: US 11,097,891 B1
(45) Date of Patent: Aug. 24, 2021

(54) ROLL-OFF TUB STYLE CONTAINER

(71) Applicant: Michael T. Patak, Elkhorn, NE (US)

(72) Inventor: Michael T. Patak, Elkhorn, NE (US)

( * ) Notice: Subject to any disclaimer, the term of this patent is extended or adjusted under 35 U.S.C. 154(b) by 100 days.

(21) Appl. No.: 16/260,759

(22) Filed: Jan. 29, 2019

(51) Int. Cl.
*B65D 88/12* (2006.01)
*B65D 90/02* (2019.01)
*B65D 90/18* (2006.01)

(52) U.S. Cl.
CPC ..... *B65D 88/123* (2013.01); *B65D 90/02* (2013.01); *B65D 90/18* (2013.01)

(58) Field of Classification Search
CPC .. B65D 88/123; B65D 88/127; B65D 88/129; B65D 88/56; B65D 90/18; B65D 90/02; B65D 90/027; B65D 2588/125; B65D 2590/24; B65F 1/1473; B60B 37/10; B60P 1/6463; B60P 1/6418
USPC ..... 220/1.5, 4.22, 4.24, 529–530, 562, 606, 220/627; 206/524.4–524.5, 596; 56/27.5; 280/30, 33, 98, 79.11
See application file for complete search history.

(56) References Cited

U.S. PATENT DOCUMENTS 1,640,796 A * 8/1927 Miller, Jr. ..... E04F 15/14 404/17
2,392,789 A * 1/1946 Watter ..... B64C 1/20 193/41
3,578,375 A * 5/1971 Finefrock ..... B60R 13/01 296/39.2
3,729,230 A * 4/1973 Tomlinson, Jr. ..... B60P 1/286 298/7
3,912,325 A * 10/1975 Sudyk ..... B60R 13/01 296/39.2
3,935,959 A * 2/1976 Long ..... A24B 1/08 220/529
4,029,354 A * 6/1977 Valeri ..... B60P 1/286 296/39.2
4,128,271 A * 12/1978 Gray ..... B60R 13/01 220/23.9
4,188,058 A * 2/1980 Resa ..... B60R 13/01 296/208
4,259,787 A * 4/1981 Minshall ..... A24B 1/08 220/4.22
4,273,381 A * 6/1981 Bibeau ..... B62D 33/02 296/183.2
4,426,020 A * 1/1984 Presseau ..... B65D 88/123 137/544
4,466,450 A * 8/1984 Huszczo ..... A24B 1/02 131/300

(Continued)

*Primary Examiner* — Chun Hoi Cheung
*Assistant Examiner* — Brijesh V. Patel

(57) ABSTRACT

A roll-off tub style container is disclosed with the container having a floor with a forward end, a rearward end, a first side, a second side, an upper side and a lower side. The container has a front wall, a first side wall, a second side wall and a tail gate. The upper side of the floor has a plurality of elongated and horizontally spaced-apart rail members which are welded to the upper side of the floor. The rail members extend between the forward and rearward ends of the floor. In the preferred embodiment, the rail members are angle members which have an inverted V-shaped configuration. Rail members having different cross-sectional configurations may possibly be utilized. The rail members prevent materials in the container from freezing to the floor of the container and also act as slide members when the material in the container is being dumped therefrom.

4 Claims, 6 Drawing Sheets

(56) References Cited

U.S. PATENT DOCUMENTS 4,650,086 A * 3/1987 Morrison, Jr. ..... B65F 1/02 220/606
5,188,418 A * 2/1993 Walworth, Jr. .... B62D 25/2054 296/184.1
5,284,266 A * 2/1994 Januel ..... B60P 1/6463 108/56.1
5,322,350 A * 6/1994 Hinson ..... B60P 3/42 296/184.1
5,518,285 A * 5/1996 Dick ..... B60P 1/286 296/183.2
5,662,374 A * 9/1997 Wheeler ..... B60P 1/286 296/183.2
5,899,519 A * 5/1999 Doshi ..... B60R 13/01 296/183.1
6,375,250 B1 * 4/2002 McWilliams ..... B60P 1/28 296/183.1
6,824,338 B2 * 11/2004 Looker ..... B60P 7/13 410/67
6,877,440 B1 * 4/2005 Kilian ..... B60P 1/286 105/406.1
7,306,273 B2 * 12/2007 Estes ..... B60P 1/6463 220/1.5
8,033,776 B2 * 10/2011 Calhoun ..... B65G 67/24 414/510
8,777,324 B2 * 7/2014 Wink ..... B60P 1/12 298/19 R
8,789,722 B2 * 7/2014 Reuthe ..... B65D 88/128 220/628
8,833,580 B2 * 9/2014 Rogers ..... B65D 90/24 220/1.5
10,099,852 B2 * 10/2018 Jorgensen ..... B65D 90/027
2001/0031185 A1 * 10/2001 Swensen ..... B60P 7/0807 410/96
2004/0083671 A1 * 5/2004 Johnson ..... B65D 90/0033 52/511
2005/0056640 A1 * 3/2005 Acosta ..... B65D 88/123 220/1.5
2005/0152774 A1 * 7/2005 Pierce ..... B60P 1/00 414/809
2008/0087667 A1 * 4/2008 Chen ..... B65D 90/027 220/1.5
2009/0127256 A1 * 5/2009 Norris, Jr. ..... B60H 1/00014 220/1.5

* cited by examiner

ROLL-OFF TUB STYLE CONTAINER

BACKGROUND OF THE INVENTION

Field of the Invention

This invention relates to a roll-off tub style container and more particularly to a roll-off tub style container which has a plurality of elongated and spaced-apart rail members welded to the floor of the container to prevent materials in the container from freezing to the floor of the container and which also act as slide members when the material in the container is being dumped therefrom.

Description of the Related Art

Many types of containers have been previously provided for transporting materials. Common types of containers are the roll-off tub style containers. In the prior art containers, a problem persists with the materials in the containers freezing to the floor of the container. If some of the material in the container is frozen to the floor thereof, it is difficult, if not impossible, to dump all the materials in the container therefrom.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

The container of this invention includes a horizontally disposed floor having a forward end, a rearward end, a first side, a second side, an upper side and a lower side. The container has a front wall, a first side wall, a second side wall, and a tail gate. The upper side of the floor of the container has a plurality of elongated and horizontally spaced-apart rail members which are welded to the upper side of the floor. The rail members extend between the forward and rearward ends of the floor. In the preferred embodiment, the rail members are angle members which have an inverted V-shaped configuration. Rail members having a different cross-sectional configuration may possibly be utilized.

In use, the material in the container will rest on the upper ends of the rail members and will be supported on the rail members above the floor of the container so that the material will not freeze to the floor. The rail members also enhance the dumping operation of the materials from the container.

It is a principal object of the invention to provide an improved roll-off tub style container.

It is a further object of the invention to provide an improved container for transporting materials.

It is a further object of the invention to provide an improved container which prevents material therein from freezing to the floor of the container.

Yet another object of the invention is to provide an improved container which has a plurality of elongated and horizontally spaced-apart rail members which are secured to the floor of the container which also enhances the dumping of the material from the container.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
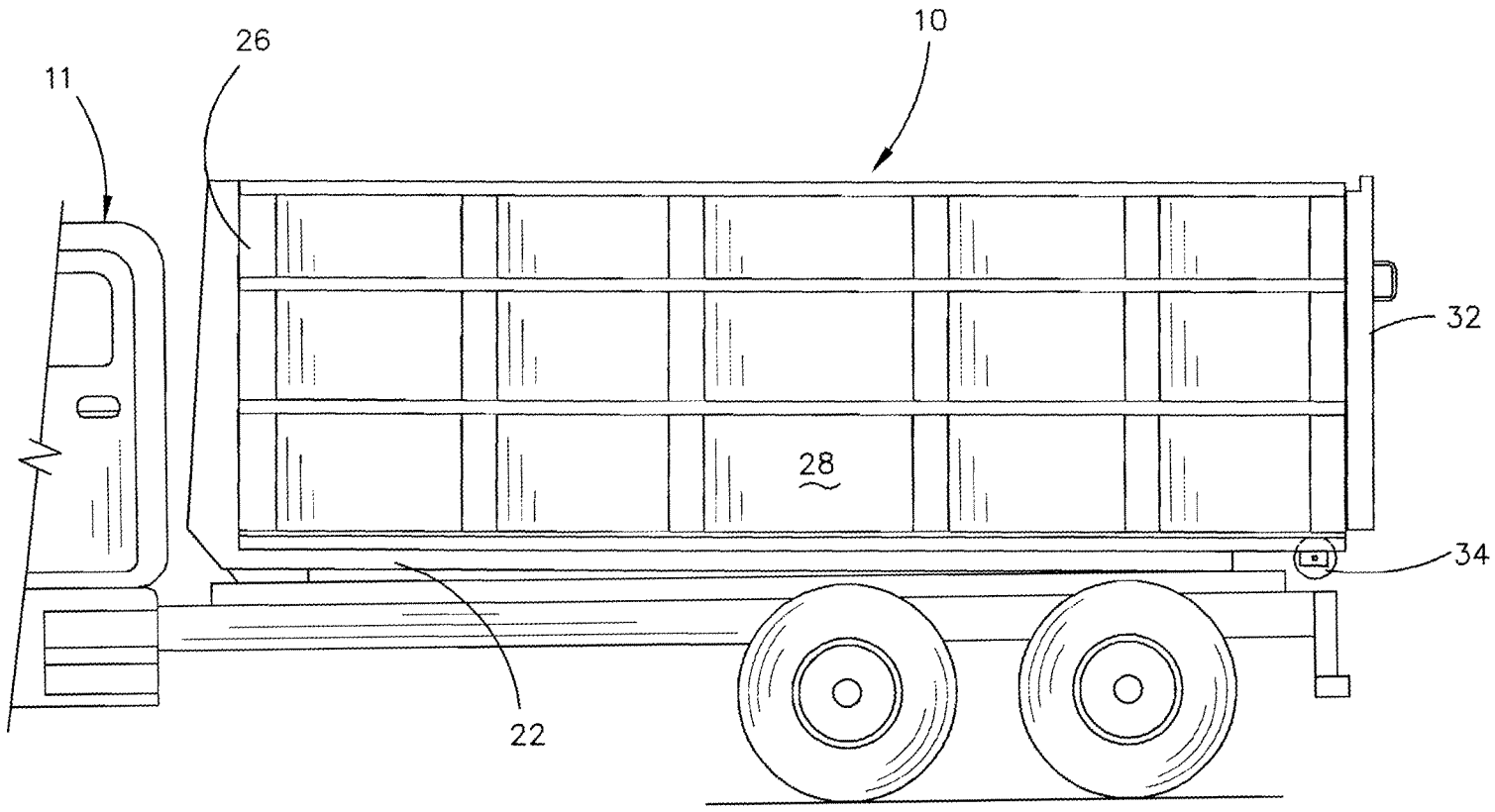
FIG. 1 is a partial side view of the container of this invention being mounted on a truck.
Figure 2:
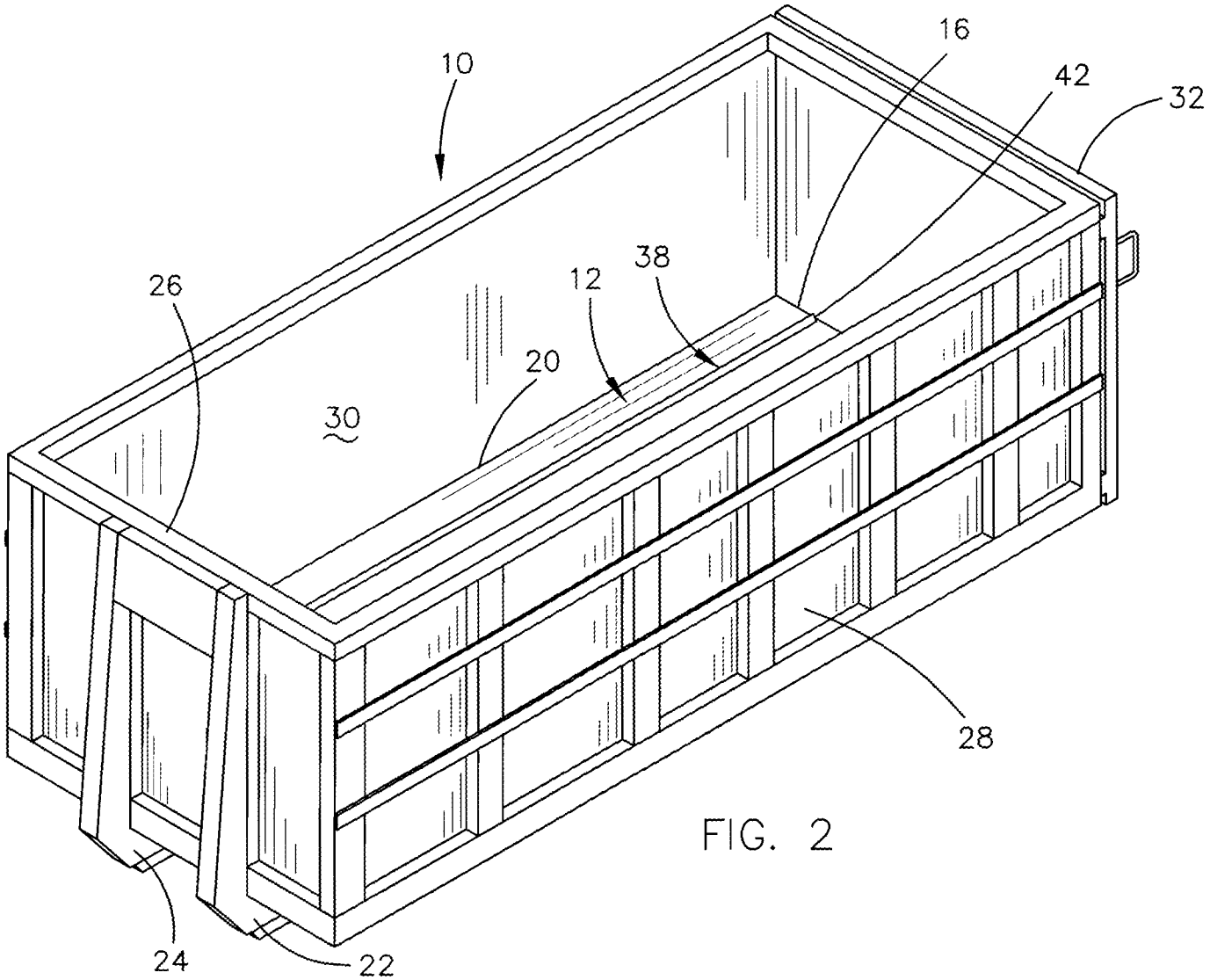
FIG. 2 is a front upper perspective view of the container of this invention.
Figure 3:
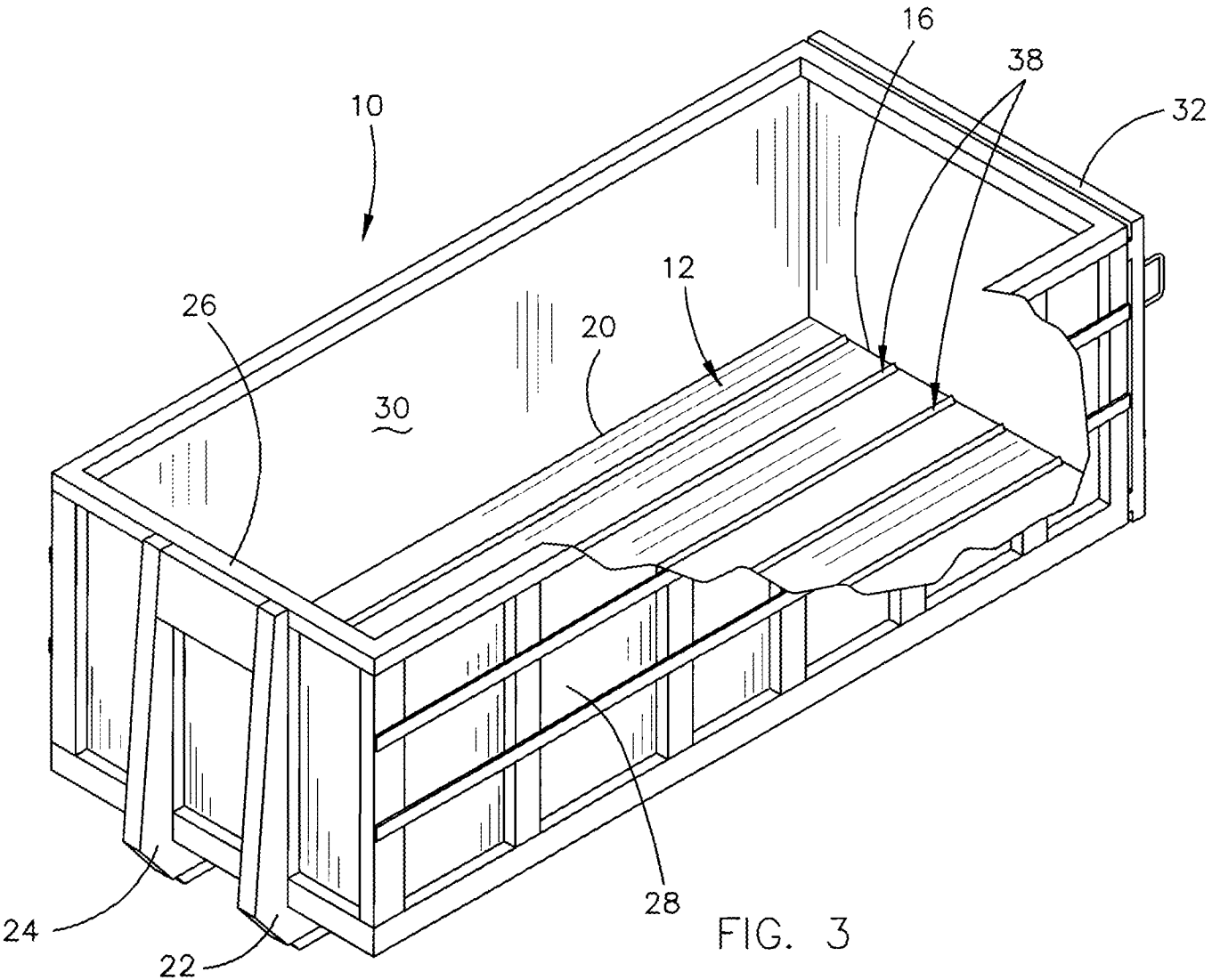
FIG. 3 is a front upper perspective view of the container of this invention with a portion thereof being cut-away to more fully illustrate the invention.
Figure 4:
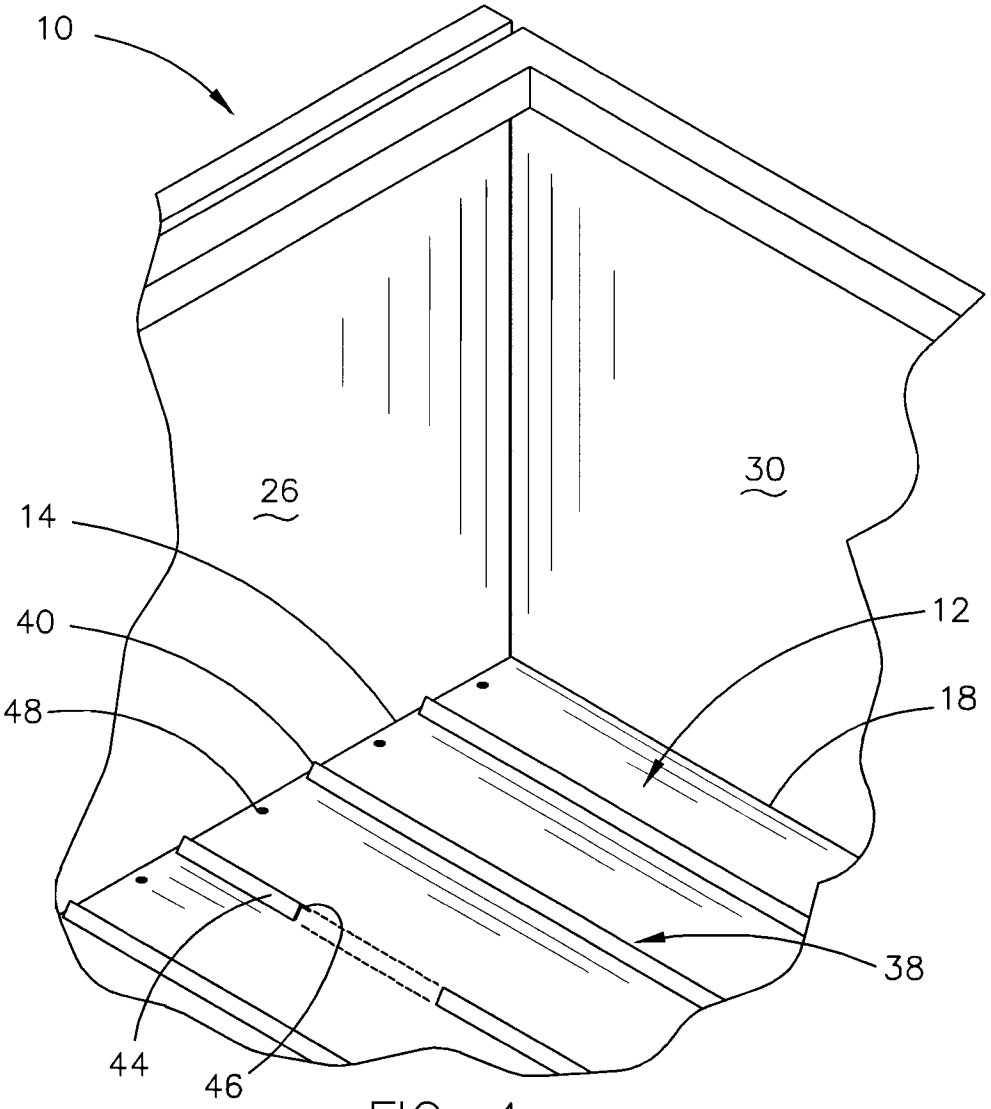
FIG. 4 is a partial perspective view of the container of this invention which illustrates a portion of the front wall of the container, one side of the container and the floor of the container.
Figure 5:
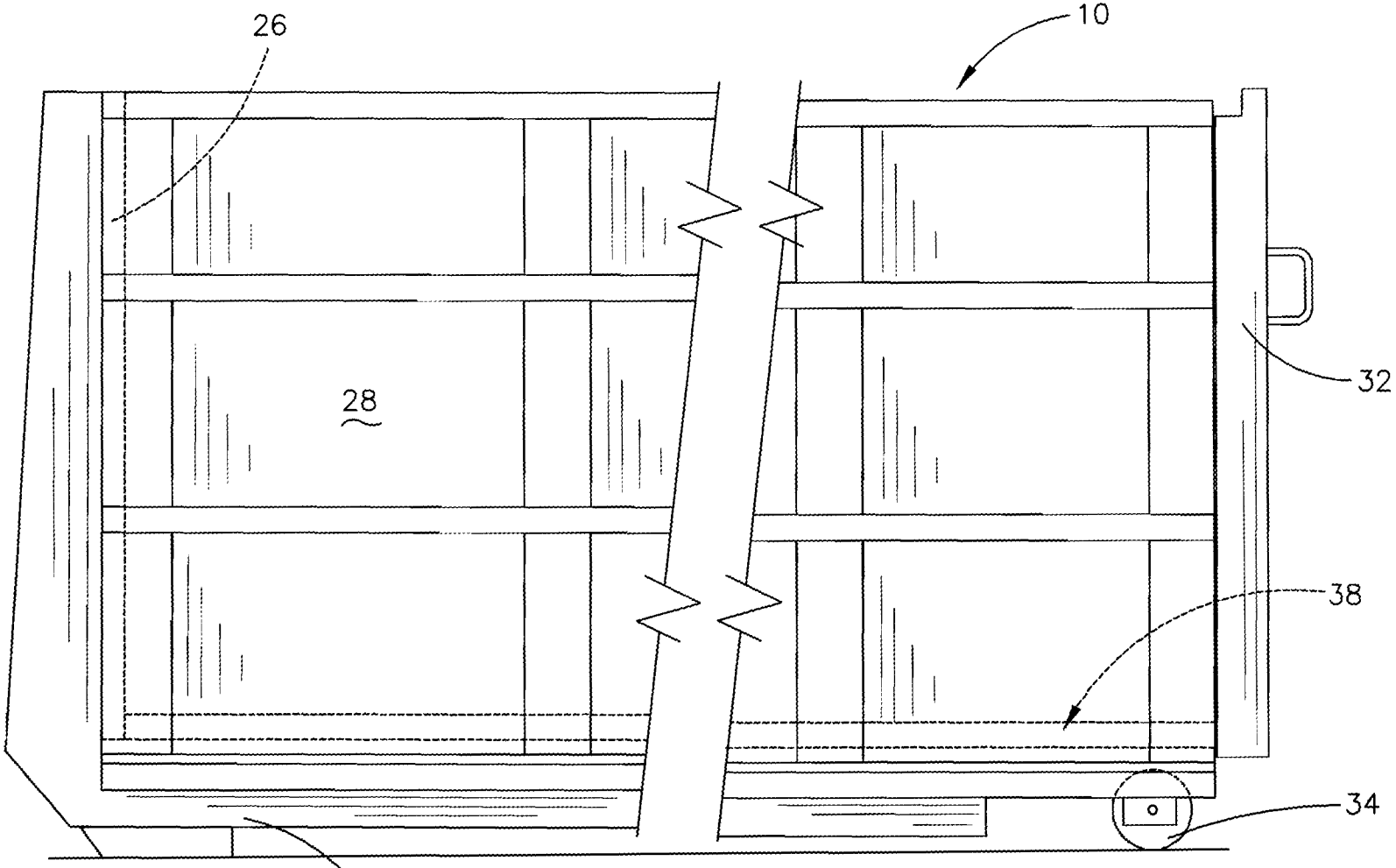
FIG. 5 is a partial side elevational view of the container of this invention.
Figure 6:
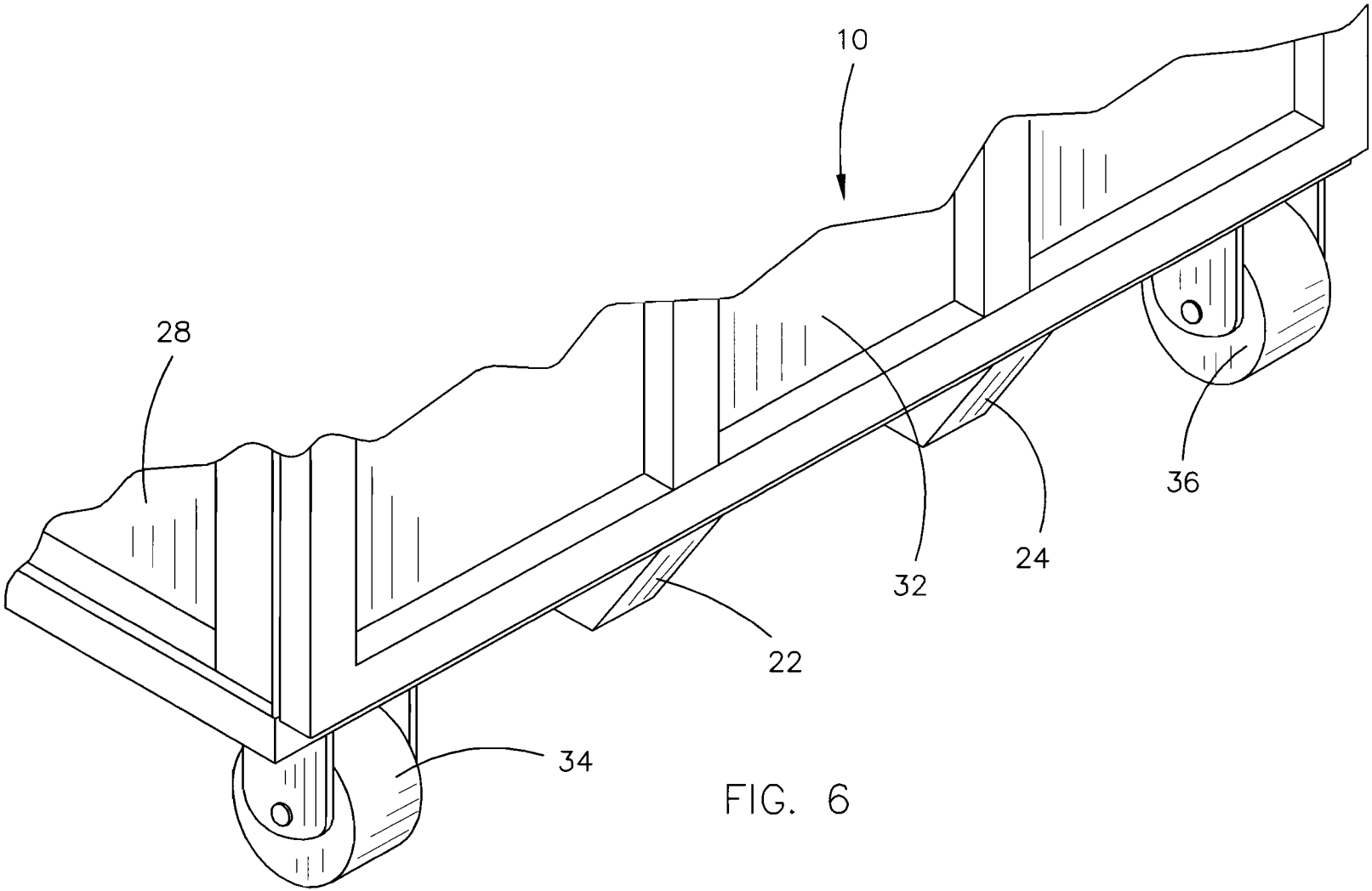
FIG. 6 is a partial rear view of the container of this invention.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to the roll-off tub style of this invention which is designed to be mounted on a truck 11. Container 10 includes a horizontally disposed or generally horizontally disposed floor 12 having a forward end 14, a rearward end 16, a first side 18 and a second side 20. Floor 12 is supported on longitudinally extending frame members 22 and 24 of the container 10 in conventional fashion.

A front wall 26 extends upwardly from the forward end 14 of floor 12. A side wall 28 extends upwardly from side 18 of floor 12. A side wall 30 extends upwardly from side 20 of floor 12. A tail gate 32 is positioned at the rear ends of side walls 28 and 30. Roll-off rollers 34 and 36 are provided at the rearward end of container 10 in conventional fashion.

Floor 12 has a plurality of elongated and horizontally spaced-apart metal rail members 38 welded to the upper side of floor 12 in a horizontally spaced-apart manner. Each of the rail members 38 have a forward end 40 positioned adjacent front wall 26 and a rearward end 42 positioned at the rearward end 16 of floor 12.

Preferably, each of the rail members 38 are angle members. Preferably, the rail members 38 have an inverted V-shape with the lower ends of the sides 44 and 46 thereof being welded to the floor 12. Although it is preferred that the rail members 38 are angle members, the rail members 38 may have different shapes. Preferably, floor 12 has a plurality of drain openings 48 formed therein at the forward end thereof.

The rail members 38 support the material in the container 10 from coming into contact with the floor 12 thereby preventing the material in the container from being frozen to the floor 12. Further, the rail members 38 act as slide members to enhance the slidable movement of the material in the container 10 when the materials are dumped from the container.

Although the rail members 38 are used with roll-off containers 10, they have utility with other containers used to transport material.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. A roll-off container having a forward end, a rearward end, a first side and a second side for transporting materials, comprising:

a metal floor having a forward end, a rearward end, a first side, a second side, an upper side and a lower side;

a front wall extending upwardly from said forward end of said metal floor between said first and second sides of said metal floor;

a first side wall extending upwardly from said metal floor at said first side of said metal floor;

said first side wall having forward and rearward ends;

a second side wall extending upwardly from said metal floor at said second side of said metal floor;

said second side wall having forward and rearward ends;

a selectively closable tail gate, having upper and lower ends, at said rearward ends of said first and second side walls;

a plurality of horizontally disposed and horizontally spaced-apart elongated metal rail members, having forward and rearward ends, secured to said upper side of said metal floor;

said metal floor being exposed between said plurality of horizontally disposed and horizontally spaced-apart metal rail members;

said forward ends of said plurality of horizontally disposed and horizontally spaced-apart elongated metal rail members being positioned at said forward end of said metal floor;

said rearward ends of said plurality of horizontally disposed and horizontally spaced-apart elongated metal rail members being positioned at said rearward end of said metal floor;

said plurality of said horizontally disposed and horizontally spaced-apart elongated metal rail members being configured to support material in the roll-off container from coming into contact with said metal floor thereby preventing the material in the roll-off container from being frozen to said upper side of said metal floor and further being configured to function as slide members to enhance the slidable movement of the material in the roll-off container when the materials are dumped from the rearward end of the roll-off container;

said plurality of horizontally disposed and horizontally spaced-apart elongated metal rail members with each of said plurality of horizontally disposed and horizontally spaced-apart elongated metal rail members having upper and lower ends;

said upper end of each of said plurality of horizontally disposed and horizontally spaced-apart elongated metal rail members being positioned above said upper surface of said metal floor; and said lower end of each of said plurality of horizontally disposed and horizontally spaced-apart elongated metal rail members being welded to said metal floor.

2. The roll-off container of claim 1 wherein each of said plurality of horizontally disposed and horizontally spaced-apart metal rail members have an inverted V-shaped cross-section.

3. A dump container having a forward end, a rearward end, a first side and a second side for transporting materials, comprising:

a metal floor having a forward end, a rearward end, a first side, a second side, an upper side and a lower side;

a front wall extending upwardly from said forward end of said metal floor between said first and second sides of said metal floor;

a first side wall extending upwardly from said metal floor at said first side of said metal floor;

said first side wall having forward and rearward ends;

a second side wall extending upwardly from said metal floor at said second side of said metal floor;

said second side wall having forward and rearward ends;

a selectively closable tail gate, having upper and lower ends, at said rearward ends of said first and second side walls;

a plurality of horizontally disposed and horizontally spaced-apart elongated metal rail members, having forward and rearward ends, secured to said upper side of said metal floor;

said forward ends of said plurality of horizontally disposed and horizontally spaced-apart elongated metal rail members being positioned at said forward end of said metal floor;

said rearward ends of said plurality of horizontally disposed and horizontally spaced-apart elongated metal rail members being positioned at said rearward end of said metal floor;

said plurality of said horizontally disposed and horizontally spaced-apart elongated metal rail members being configured to support material in the dump container from coming into contact with said metal floor thereby preventing the material in the dump container from being frozen to said metal floor and further being configured to function as slide members to enhance the slidable movement of the material in the dump container when the materials are dumped from the rearward end of the container;

said plurality of horizontally disposed and horizontally spaced-apart elongated metal rail members with each of said plurality of horizontally disposed and horizontally spaced-apart elongated metal rail members having upper and lower ends;

said upper end of each of said plurality of horizontally disposed and horizontally spaced-apart elongated metal rail members being positioned above said upper surface of said metal floor;

said lower end of each of said plurality of horizontally disposed and horizontally spaced-apart elongated metal rail members being welded to said metal floor; and said metal floor being exposed between said plurality of horizontally disposed and horizontally spaced-apart elongated metal rail members.

4. The dump container of claim 3 wherein each of said plurality of horizontally disposed and horizontally spaced-apart metal rail members have an inverted V-shaped cross-section.

* * * * *